US005414881A

United States Patent [19]

Terrazas

[11] Patent Number: 5,414,881

[45] Date of Patent: May 16, 1995

[54] COMBINATION STADIUM BLANKET/WATERPROOF COVERING AND CUSHION

[76] Inventor: Ernest F. Terrazas, 7026 E. Warner Rd., Tempe, Ariz. 85284

[21] Appl. No.: 184,251

[22] Filed: Jan. 18, 1994

[51] Int. Cl.[6] ..... A47G 9/00; A41D 15/04

[52] U.S. Cl. ..... 5/417; 5/482; 5/654; 5/485; 2/202; 190/1

[58] Field of Search ..... 5/417–420, 5/654, 482, 485; 190/1, 2; 383/4; 2/205, 202, 209.11

[56] References Cited

U.S. PATENT DOCUMENTS

| | | | |
|---|---|---|---|
| D. 306,543 | 3/1990 | Pestuglicci et al. | D6/601 |
| 2,045,784 | 6/1936 | Leve | 5/419 |
| 2,315,126 | 3/1943 | Michalke, nee Parnow . | |
| 3,958,274 | 5/1976 | Klauber | 5/420 |
| 4,188,988 | 2/1980 | Agyagos | 5/417 |
| 4,466,516 | 8/1984 | Sicoli et al. | 5/419 |
| 5,099,530 | 3/1992 | Scott | 5/419 |
| 5,110,219 | 5/1992 | Lopes | 5/417 |
| 5,203,041 | 4/1993 | Alonso | 5/420 |
| 5,217,034 | 6/1993 | Yih et al. | 5/420 |

*Primary Examiner*—Alexander Grosz
*Attorney, Agent, or Firm*—Schmeiser, Olsen & Watts

[57] ABSTRACT

The invention is an article that combines the functions of a stadium blanket, rain covering and seat cushion. The article has a basically rectangular, sheet-like body that has a waterproof top layer and a flannel bottom layer. To enhance its usefulness as a rain covering, the article includes a waterproof hood attached to one edge of the body. The body also includes a closable pocket or cavity that is adapted to receive and store the hood. The article may include one or more corner-located pockets that may be employed to temporarily store items such as sunglasses or small food containers.

16 Claims, 2 Drawing Sheets

COMBINATION STADIUM BLANKET/WATERPROOF COVERING AND CUSHION

FIELD OF THE INVENTION

The invention is in the field of multi-purpose articles. More particularly, the invention is a blanket-sized covering that has a waterproof top surface and a fabric bottom surface. In its unfolded form, the covering can function as a blanket or as a waterproof covering. An attached waterproof hood enhances the latter use. In its folded form, the covering can be used as a seat cushion.

BACKGROUND OF THE INVENTION

Many people who go to sporting events, parks or concerts typically find that they have to bring a large number of items to ensure their comfort during the event. If it will be cold, a blanket will normally be brought. A blanket is also commonly employed as a ground covering if regular seats are not provided. However, if the ground is damp, a waterproof tarp must be placed beneath the blanket or used in its place.

For those who attend an event where seats are provided, the seats will often be made of hard plastic or metal. Seats of this type are usually quite uncomfortable and many users will therefore bring a soft cushion with them.

If a person is visiting an outdoor area and there is a chance of rain, the person will additionally bring raingear or some other type of waterproof covering. As noted above, a waterproof covering may also be necessary if the user will be sitting on damp ground.

From the above, it can be seen that the extra items necessary for user comfort or protection can add up to a considerable burden that the user must carry. In addition, it is easy to forget to bring a necessary item or the weather may turn inclement without warning thereby catching a person without any protective covering.

SUMMARY OF THE INVENTION

The invention is a combination article that may be conveniently employed by a person who is visiting a park or who is attending an event such as a concert or ball game. The article combines the functions of a seat cushion, a blanket and a waterproof covering. For the latter function, the article includes a waterproof hood that is removably stored within an internal, closeable pocket.

The invention is primarily composed of a large sheet of material that measures approximately four feet long by five feet wide. The sheet of material has a top waterproof layer and a bottom fabric layer. A layer of soft insulating material such as polyester batting may optionally be located between the top and bottom layers.

For the waterproof layer, a PVC or other synthetic waterproof material may be employed as well as a tightly woven nylon material. This layer functions to prevent water from readily passing through the material.

The bottom fabric layer is preferably a cotton flannel material. This layer provides warmth and a surface that is comfortable to the touch.

In its normal, folded condition, the invention is similar in size and shape to a briefcase and includes carry handles to allow it to be carried in a similar manner. A retaining strap is secured to the sheet at a location where, when the article is in its folded form, the strap can be extended from one side of the article to the other and be releasably secured in that position to maintain the article in its folded condition. In this state, the invention is easy to transport and can readily be used as a seat cushion.

A user may partially unfold the article thereby allowing it to cover a larger area. For example, in this condition the unit can be used as a cushion for two adjacent seats or to cover both the seat and back portions of a single chair.

If a user wishes to use the article as a blanket, he or she would completely unfold the article and drape it over his or her body with the flannel layer facing down. In this manner, the article is functionally identical to a stadium blanket.

In its unfolded condition, the article can also be used as a ground covering. With its waterproof side facing down, the article would protect the user from damp ground.

The article, when fully unfolded can also be used to protect the user from rain by placing it over the user in the same manner as described above. With its flannel layer facing the user, its waterproof layer forms the top surface of the article and protects the user from the rain. When the article is being used in this fashion, it is similar to a waterproof tarpaulin. However, to improve the article's effectiveness and comfort of use for this function, the article also includes a waterproof hood that is affixed to one edge of the sheet. The article has an interior cavity or pocket proximate said edge and which is adapted to store the hood when the hood is not needed. A hook and pile type fastener is employed to releasably close the opening to the cavity/pocket.

In addition, the article has at least one corner-located pocket formed of a waterproof material. The pocket is usable to store smaller items such as sunglasses or small foodstuffs.

DETAILED DESCRIPTION OF THE DRAWINGS

Figure 1:
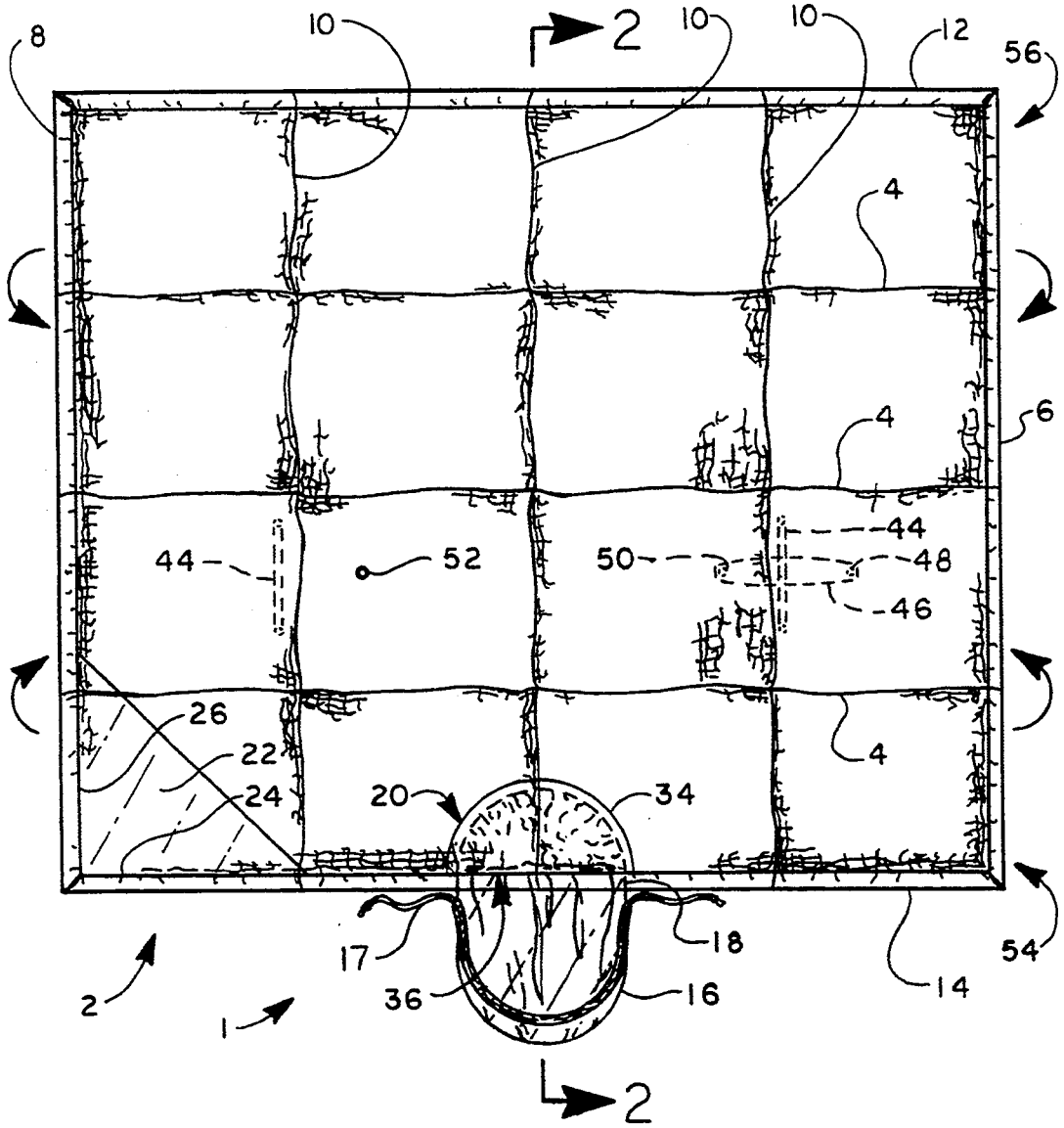
FIG. 1 shows a plan view of the invention in an unfolded condition with its fabric side facing up and its hood shown extended.

Referring now to the drawings in greater detail, wherein like reference characters refer to like parts throughout the several figures, there is shown by the numeral 1 a combination article in accordance with the invention.

The article comprises a sheet-like body portion 2 that has a length of between three and six feet and a width of between three and six feet. In the preferred embodiment, the body member is approximately four feet long by five feet wide. As shown in FIG. 1, there are three horizontally-oriented fold lines 4 that extend across the body portion from its extreme right edge 6 to its extreme left edge 8. As also shown, three vertically-oriented fold lines 10 extend from the body portion's top edge 12 to its bottom edge 14.

Shown extending outwardly from the bottom edge 14 of the body portion is a waterproof hood member 16. The hood member is similar to a hood of a conventional raincoat and is preferably fabricated from a single layer of waterproof material such as PVC or polyethylene plastic material. The hood member includes a drawstring 17 and is affixed at its bottom edge 18 to the body portion's bottom edge 14.

To store the hood member when it is not required, the body portion includes a cavity or pocket 20. The hood member is shown in phantom in its alternate, stored position within the pocket/cavity 20. The cavity may be pocket-shaped, as shown, or it may consist of a large area between adjacent layers of the body portion.

To increase the convenience of the article, a pocket 22 is shown located at a corner of the body portion. The pocket is preferably a small, triangular flap of waterproof material that is sewn on two sides 24 and 26 to the associated edges of the body member. While only one pocket is shown, the article may include additional pockets at any or all of its other corners. The pocket(s) can be used for storing small articles such as sunglasses or the like. In addition, sand or other material may be placed in the pocket(s) to weigh the body member down to enhance its stability against wind when it is used as a ground covering.

Figure 2:
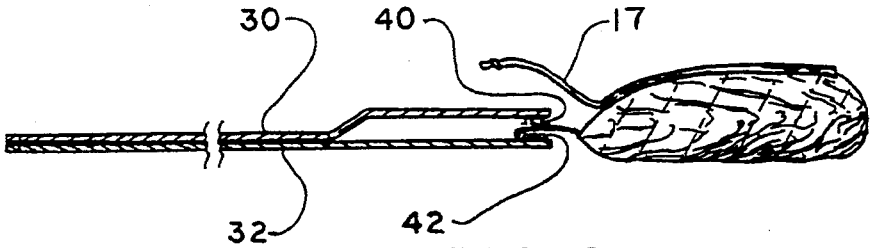
FIG. 2 provides a cross-sectional view of the invention shown in FIG. 1 and taken along a line that extends through the hood.

FIG. 2 provides a cross-sectional view of the invention and is taken along a line that crosses the hood receiving cavity 20. As can be seen, the body portion includes a top layer 30 of a cotton flannel material and a bottom layer 32 of a waterproof synthetic material. It should be noted that the term "waterproof" is considered to broadly include materials which are completely impermeable to the passage of water and also those which are water-resistant such as tightly woven nylon. The two layers are secured to each other along their outer edges (at edges 6, 8, 12 and 14) by stitching or other well-known fastening methods.

In the area of the hood receiving cavity/pocket 20, the two layers are separated to thereby form the cavity/pocket 20. The pocket is created by stitching together the two layers 30 and 32 along a semi-circular line 34. This creates a pocket/cavity which is sized to receive the hood member 16. Alternatively and equally preferred, no interior stitching can be made and in that case, the entire area between the two layers would be left unrestricted and the hood member can be received within the formed cavity between the two layers.

The pocket/cavity has an outer opening 36 in which complementary portions 40 and 42 of hook and pile fastening material are attached to the facing surfaces of the two layers of the body portion. When the hood member is located within the pocket, the two portions 40 and 42 are brought together thereby fastening closed the cavity/pocket and securing the hood member within the body portion.

As can also be seen in FIG. 1, two carry handles 44 (shown in phantom) are secured to the body member and extend outwardly from layer 32. The handles are preferably formed from strips of flexible material such as leather or nylon and are attached at each end by sewing or the like to the body member. Alternatively, a single carry handle may be employed and secured using hook and pile fastening material. In addition, a retaining strap 46 is also shown in phantom and is attached at one end by a snap assembly 48 to layer 32 of the body member proximate one of the carry handles. The snap-type fastener is preferably used to allow releasable attachment of the strap to the body portion. The other end of the retaining strap has a snap fastener 50 that can be releasably secured to a complementary fastening portion 52 that is secured to layer 32 proximate the other carry handle.

Figure 4:
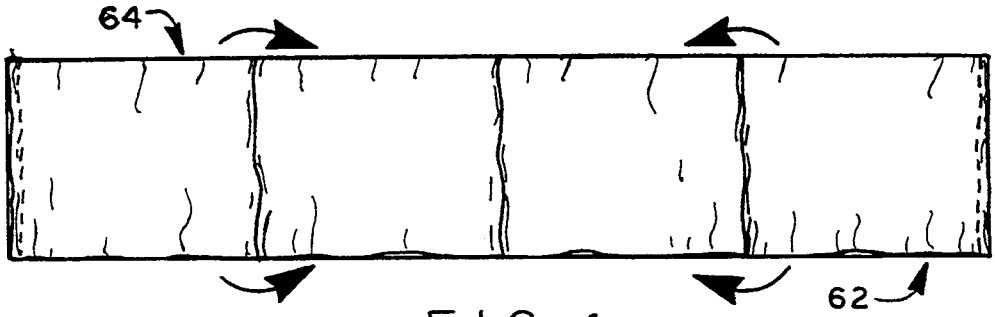
FIG. 4 shows the invention of FIG. 1 in a second stage of being folded.
Figure 5:
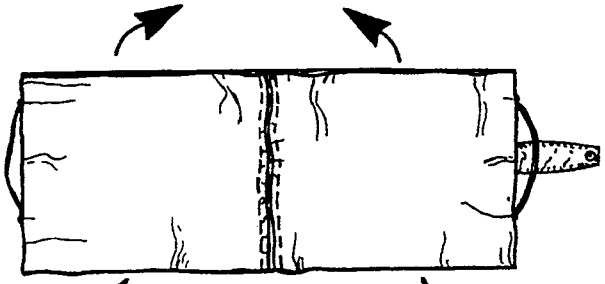
FIG. 5 shows the invention of FIG. 1 in a third stage of being folded.
Figure 6:
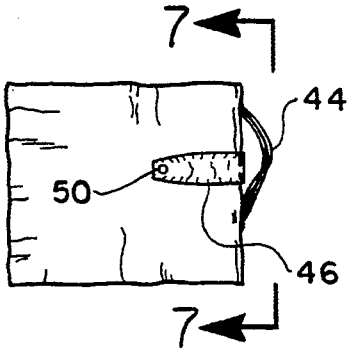
FIG. 6 shows the invention of FIG. 1 in a fully folded condition.

FIGS. 3 thru 6 show the invention in successive stages of folding from its unfolded condition shown in FIG. 1 to its fully folded condition shown in FIG. 6.

Figure 3:
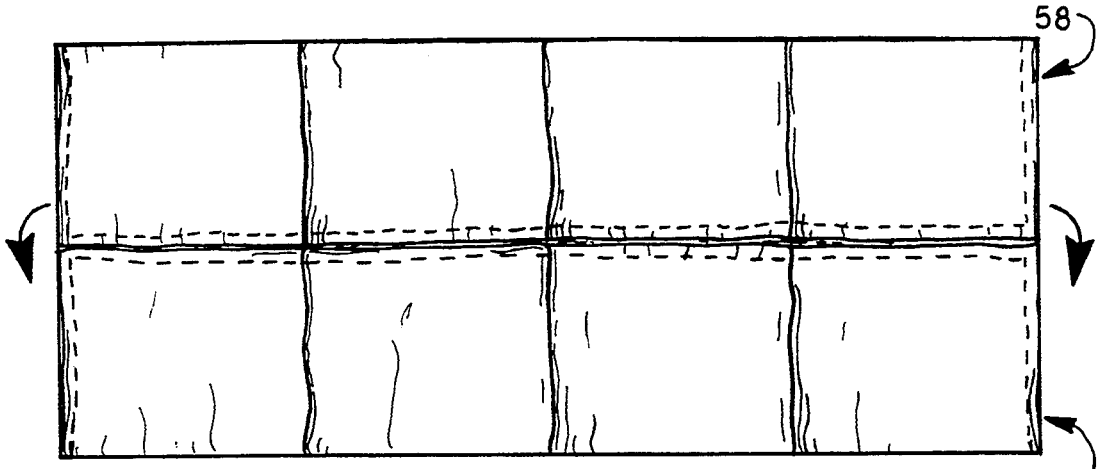
FIG. 3 shows the invention of FIG. 1 in a first stage of being folded.

In FIG. 3, the top and bottom portions 54 and 56 respectively (shown in FIG. 1) of the body portion have been folded inwardly about the top and bottom fold lines 4.

In FIG. 4, top portion 58 (shown in FIG. 3) has been folded about the center fold line 4 onto portion 60 (shown in FIG. 3).

In FIG. 5, the outer right hand portion 62 and outer left hand portion 64 that are shown in FIG. 4 have been folded inwardly about the outer right and left fold lines 10.

Figure 7:
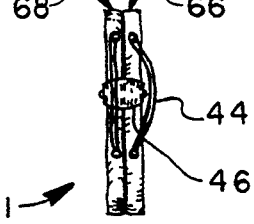
FIG. 7 shows an end view of the invention shown in FIG. 6.

In FIGS. 6 and 7, the right and left portions, 66 and 68 respectively shown in FIG. 5 have been folded together about the center fold line 10.

When fully folded as shown in FIGS. 6 and 7, the two carry handles 44 are located adjacent to each other at one end of the folded article. The retaining strap 46 may then be pulled over the end of the unit where it extends from the outer surface of portion 66 to the outer surface of portion 68. It may then be releasably secured to portion 68 by securing the two portions of the snap assembly 50, 52 where it then functions to maintain the article in its folded condition. Alternatively, the retaining function can be accomplished using spaced complementary portions of hook and pile fastening material (or similar fasteners) that are located to face each other when the article is folded in the manner shown in FIG. 6.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A combination article, adapted to be used as a blanket or waterproof covering, and adapted to be folded along fold lines into a seat cushion, comprising:

a planar body portion that is flexible and has a waterproof top surface and a cloth bottom surface, said body portion having a top edge, a bottom edge, a right-side edge and a left-side edge and wherein said body portion has a width of between three and ten feet and a length of between three and ten feet;

a waterproof hood member secured proximate one of said side edges of said body portion; and a cavity located within said body member, said cavity being located proximate said hood and having an opening and a size which allows it to inwardly receive and contain said hood.

2. The combination article of claim 1 further comprising first and second carry handles affixed to said body portion and located inwardly of the right-side and left-side edges of the body portion.

3. The article of claim 1 further comprising a fastening means located at a peripheral edge of the cavity that receives the hood member, said fastening means functioning to releasably close an opening that leads to said cavity.

4. The article of claim 3 wherein the fastening means that is used to close the cavity is comprised of complementary portions of hook and pile fastening material.

5. The article of claim 1 wherein the cavity is centered between the right and left side edges of the body portion.

6. The article of claim 1 wherein the bottom layer of the body portion is composed of a flannel material.

7. The article of claim 1 further comprising a pocket means located at a corner portion of the body portion.

8. The article of claim 1 wherein the body portion is approximately four feet long by five feet wide.

9. The article of claim 2 wherein the body portion can be folded in a predetermined manner into twelve substantially identical portions and wherein when folded in said predetermined manner, the first and second carry handles are located adjacent to each other.

10. The article of claim 2 further comprising a retaining means that has one portion affixed to said body portion at a location proximate said first carry handle and a second portion located proximate the second carry handle.

11. The article of claim 10 wherein the retaining means comprises an elongated strap having first and second ends and fastening means located on said body portion that enables the strap to be fastened to the body portion proximate each of said first and second carry handles.

12. A combination article, adapted to be used as a blanket or waterproof covering, and adapted to be folded along fold lines into a seat cushion, consisting essentially of:

a planar body portion that is flexible and has a waterproof top surface and a cloth bottom surface, said body portion having a top edge, a bottom edge, a right-side edge and a left-side edge;

carry handle means affixed to said body portion and located inwardly of the right-side and left-side edges of the body portion;

a retaining means affixed at a first end to said body portion at a location proximate said carry handle means;

a waterproof hood secured to said body portion proximate one of the edges of said body portion; and a cavity located within said body member, said cavity being located proximate said hood and having an opening and a size which allows it to inwardly receive and contain said hood.

13. The article of claim 12 wherein the body portion can be folded in a predetermined manner into twelve substantially equal portions and wherein when folded in said predetermined manner, the carry handle means will be located proximate a top end of the folded body portion.

14. The article of claim 12 further comprising a fastening means located at a peripheral edge of the cavity opening, said fastening means functioning to releasably close said cavity.

15. The article of claim 12 wherein the cavity is centered between the right and left side edges of the body portion.

16. The article of claim 12 wherein the body portion is approximately four feet long by five feet wide.

* * * * *